United States Patent [19]

Lindsey, Jr. et al.

[11] Patent Number: 4,601,343

[45] Date of Patent: Jul. 22, 1986

[54] PBR WITH LATCHING SYSTEM FOR TUBING

[75] Inventors: Hiram E. Lindsey, Jr., Midland; Roger P. Allwin; John M. Yokley, both of College Station, all of

[73] Assignee: MWL Tool and Supply Company, Midland, Tex.

[21] Appl. No.: 698,145

[22] Filed: Feb. 4, 1985

[51] Int. Cl.[4] ..... E21B 23/02

[52] U.S. Cl. ..... 166/382; 166/242; 285/142

[58] Field of Search ..... 285/140, 142, 143, 39, 285/322, 323, 208, 115–117; 166/382, 206, 242, 240, 237, 115, 208

[56] References Cited

U.S. PATENT DOCUMENTS

| | | | |
|---|---|---|---|
| 4,014,568 | 3/1977 | Carter et al. | 285/39 |
| 4,039,208 | 8/1977 | Pernet et al. | 285/140 X |
| 4,083,408 | 4/1978 | Milam | 166/208 X |
| 4,087,119 | 5/1978 | Capdebosc et al. | 166/187 X |
| 4,398,600 | 8/1983 | Vazquez | 166/242 X |
| 4,449,736 | 5/1984 | Blackwell | 166/115 X |
| 4,508,167 | 4/1985 | Weinberg et al. | 166/382 X |

*Primary Examiner*—Stephen J. Novosad
*Assistant Examiner*—David J. Bagnell

[57] ABSTRACT

A liner hanger system for wellbores where the liner hanger includes a polished bore receptacle (PBR) with a releasable latching device. In use, a string of tubing with a sealing assembly adapted for cooperation with the PBR can be releasably latched to the PBR to limit upward travel of the string of tubing relative to the PBR.

8 Claims, 10 Drawing Figures

FIG. 3
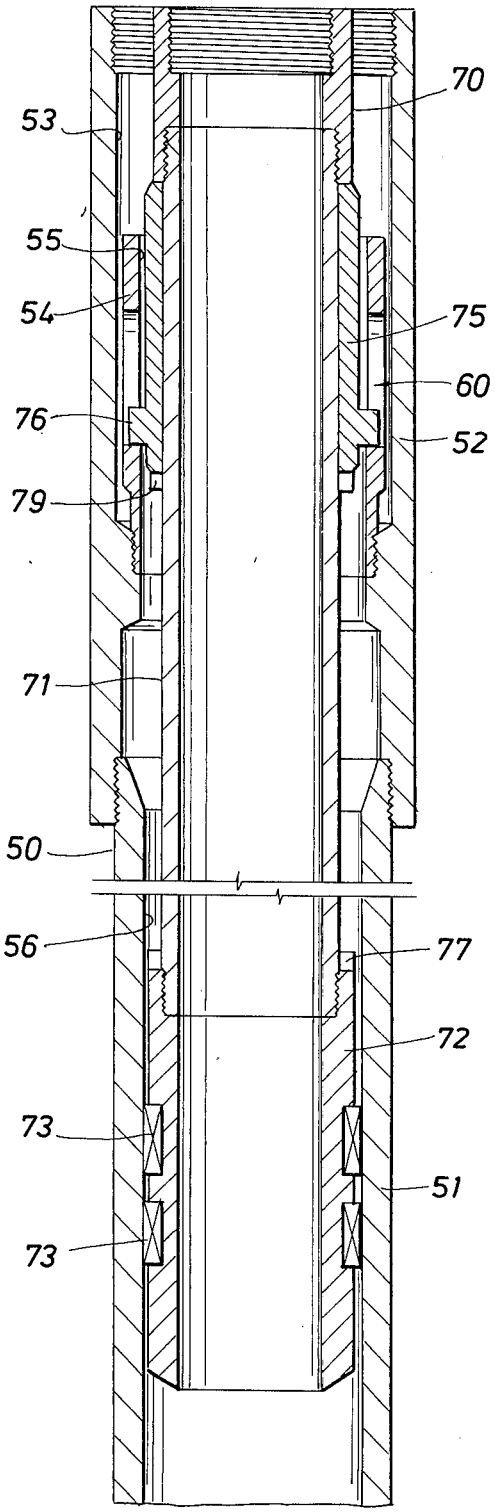
FIG. 4
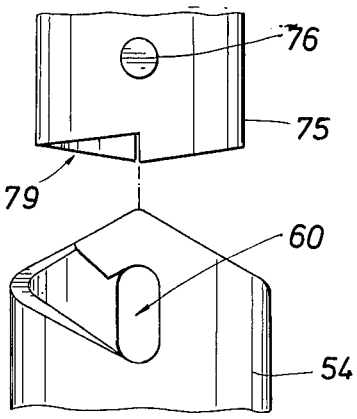
FIG. 5
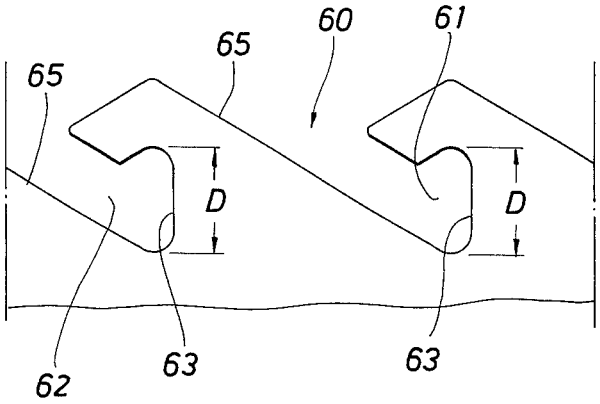
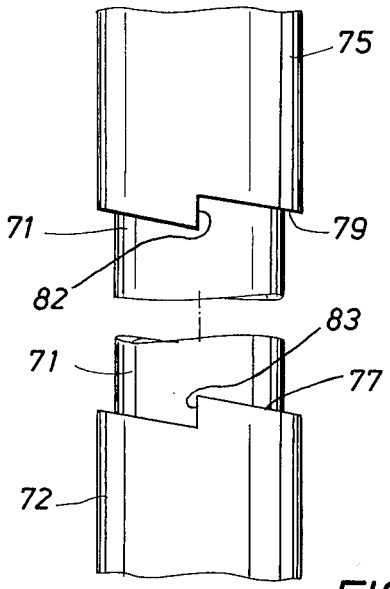
FIG. 6

PBR WITH LATCHING SYSTEM FOR TUBING

FIELD OF THE INVENTION

This invention relates to liner hanger systems for use in oil field completion operations and more particularly to liner hanger systems which utilize polished bore receptacles providing for limited movement of tubing for expansion and contraction and for providing for release of the tubing string from a polished bore receptacle when desired.

BACKGROUND OF THE INVENTION

In the completion of oil wells it is customary to have a succession of smaller diameter boreholes as a function of depth, each of the boreholes being lined with a tubular pipe member and each of which are successively cemented in place. The column of cement between the outer surface of the string of pipe and the borehole wall supports the pipe and prevents fluid migration.

As a matter of terminology, a string of pipe extending from the surface is commonly called a casing. The surface borehole is drilled a few thousand feet and the surface casing inserted into the borehole and cemented in a conventional manner. Thereafter, a smaller diameter bit is used to drill another section of borehole. A string of casing can be inserted into the second open borehole which extends to the surface and is cemented in place in a conventional matter. Alternatively, a liner can be suspended in the lower end of the surface casing and cemented in place. A liner is a string of pipe which is hung at the lower end of another string of pipe which is already in the borehole. After the next casing or liner is in position in the borehole, the drilling is continued to another depth and a string of pipe is suspended in the lower end of the next above string of pipe and cemented in place. The drilling operations continue thusly until the desired depth is reached.

To position and cement a liner in a string of casing, the liner is made up with the usual bottom hole equipment which includes a casing shoe, float collar and plug catchers and is connected up to the desired length. At the top of the liner is a liner hanger which is an assembly having slip elements which are normally retracted while going into the borehole and which are released downhole when setting of the liner hanger is desired. The liner hanger is lowered into the borehole by a setting tool which attaches to the liner hanger and a string of pipe attached to the setting tool. At the desired location where the casing shoe is preferably located above the bottom of the open borehole, the liner hanger is set in the next above casing by actuating the setting tool to set the slips on the liner hanger. Upon setting the liner hanger, the weight of the liner is suspended by the liner hanger on the next above casing. The setting tool is released and the liner hanger is then cemented by pumping cement through the string of pipe through the liner and into the annulus between the liner and borehole. After the cement is set up, the remaining cement in the liner is removed by drilling through the liner and destructible cement equipment at the lower end of the liner. When the open borehole reaches the projected well depth and traverses the formations to be completed, the liner includes a liner hanger and oftentimes polished bore receptacle (PBR). The polished bore receptacle attaches either above or below the liner hanger and provides a bore to receive a sealing member on a tubing string. Various types of polished bore configurations are available which include an insert polished bore receptacle in another polished bore receptacle where the insert polished bore receptacle is latched and locked into the other polished bore receptacle.

The production string of tubing which has a sealing element adapted to be slidingly and sealingly received in the polished bore receptacle, extends from the earth's surface and when the well is completed, fluids flow through the tubing string to the surface. The sealing element on the string of tubing is subjected to downhole hydraulic pressure forces and the tubing string is subject to expansion and contraction forces due to the temperature. The purpose of a sliding seal on a string of tubing in a polished bore receptacle is to permit movement of the seal and the string of tubing relative to the polished bore receptacle. However, if the proper tubing size and materials are not used, the pressures and temperatures encountered in production can cause the tubing string to become distorted in the wellbore and to be helically buckled. This occurs because the top of the tubing string is fixed to the earth's surface and the forces produced in the wellbore exceed the capabilities of the string of tubing. Thus excessive upward movement of the tubing string in the polished bore receptacle can force the tubing upwardly and distort it. This effect has been studied and it is common to calculate the amount of helical buckling which will occur and to compensate and provide the right length of tubing with proper strength capabilities in the wellbore so that the buckling effect is not so severe as to prevent the passage of tools through the tubing or to permanently corkscrew the tubing string in the casing. For background information, reference may be made to papers such as "Deep Well Completions Can Be Simple" by H. E. Lindsey, Jr., published in the Petroleum Engineer magazine in April, 1976; "Deep Well Completion Practice" by H. E. Lindsey, Jr., published by the American Institute of Mining, Metalurgical and Petroleum Engineers, Inc. in September, 1972; "Tubing Movement Forces And Stresses And Dual Flow Assembly Installations" by Kenneth S. Durham, published by the Society of Petroleum Engineers Journal in December, 1982; and, "Determining Clearance And Helicly Buckled Tubing" by H. Ed Lindsey, Jr., Charles W. McLarnan and James A. Nickel, published by World Oil in June, 1980.

In many instances, last minute changes can occur, such as a change in the completion where a more expensive tubing is not available or smaller sized tubing is desired. In such instances, it is not possible to change tubing design with respect to the polished bore receptacle.

DESCRIPTION OF THE PRESENT INVENTION

The present invention contemplates a polished bore receptacle which also includes a mechanical latching assembly which can be used to releasably interconnect with a latching assembly on a tubing and sealing element assembly so that the tubing string, when positioned in the wellbore with the sealing element in the polished bore receptacle, has a limited travel. This permits use of less expensive or smaller sized tubing and buckling of the tubing string cannot occur beyond a predetermined amount. Also, the tubing string and sealing assembly subsequently can be released from the polished bore receptacle and recovered in future operations.

DESCRIPTION OF THE DRAWINGS

The features of the present invention will best be understood by reference the attached claims and the drawings and descriptions that follow in which:

FIG. 3 illustrates in schematic cross section the polished bore receptacle of the present invention and the present invention embodiment of a limited travel collar;

FIG. 4 illustrates a portion of the locking mechanism embodied in the present invention;

FIG. 5 illustrates in plan view the circumference of the locking groove embodied in the present invention;

FIG. 6 illustrates a portion of the clutch mechanism to operate the locking mechanism;

DESCRIPTION OF THE PRESENT INVENTION

Figure 1:
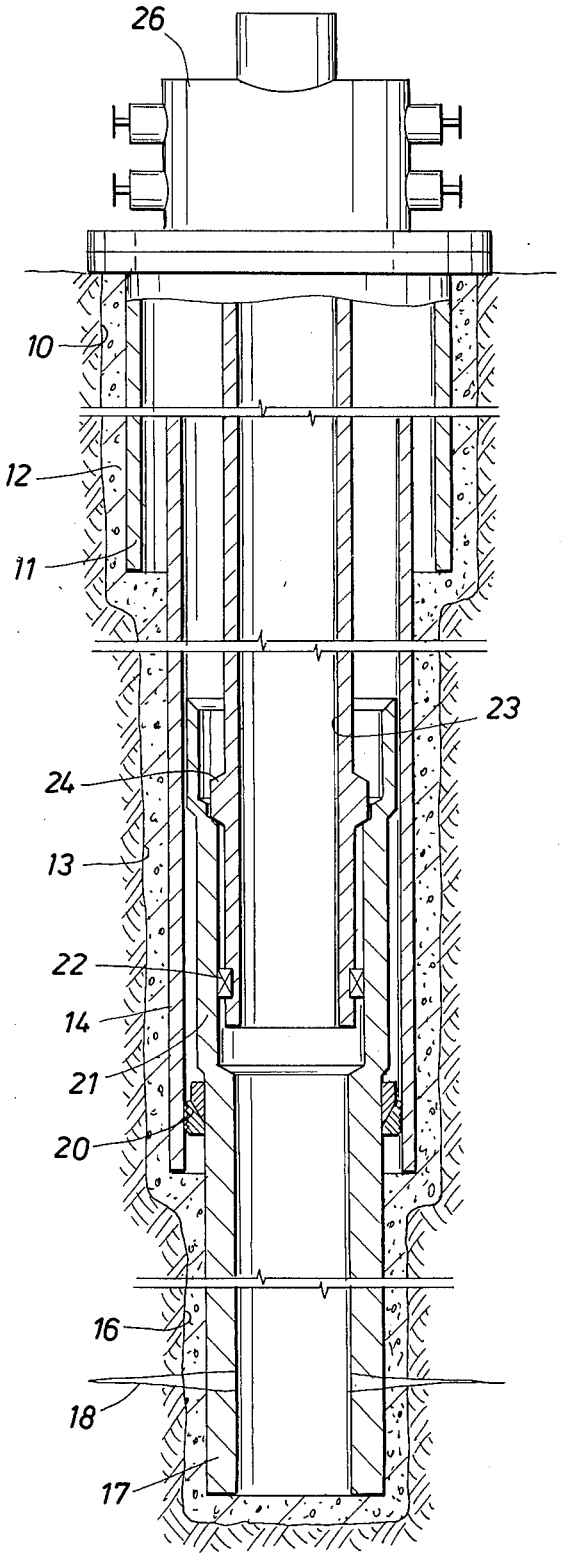
FIG. 1 illustrates a well configuration utilizing polished bore receptacles.

Referring now to FIG. 1, a surface borehole 10 is illustrated traversing earth formations. The surface borehole 10 has a surface casing 11 cemented in place by a column of cement 12. A deeper section of borehole 13 is illustrated with a liner or casing 14 cemented in place and a third deeper section 16 of borehole is illustrated with a liner 17 cemented in place and production perforations 18 into the earth formation. The third liner 17 is illustrated with a liner hanger 20 and a polished bore receptacle (PBR). The bore of the polished bore receptacle 21 which slidably and sealingly receives the sealing assembly 22 on a tubing string 23 which has a landing flange 24 which engages a shoulder in the PBR.

FIG. 1 illustrates the tubing string 23 as being attached to the wellhead 26 at the surface and illustrates the conditions under which helical buckling of the tubing string 23 can occur.

Figure 2:
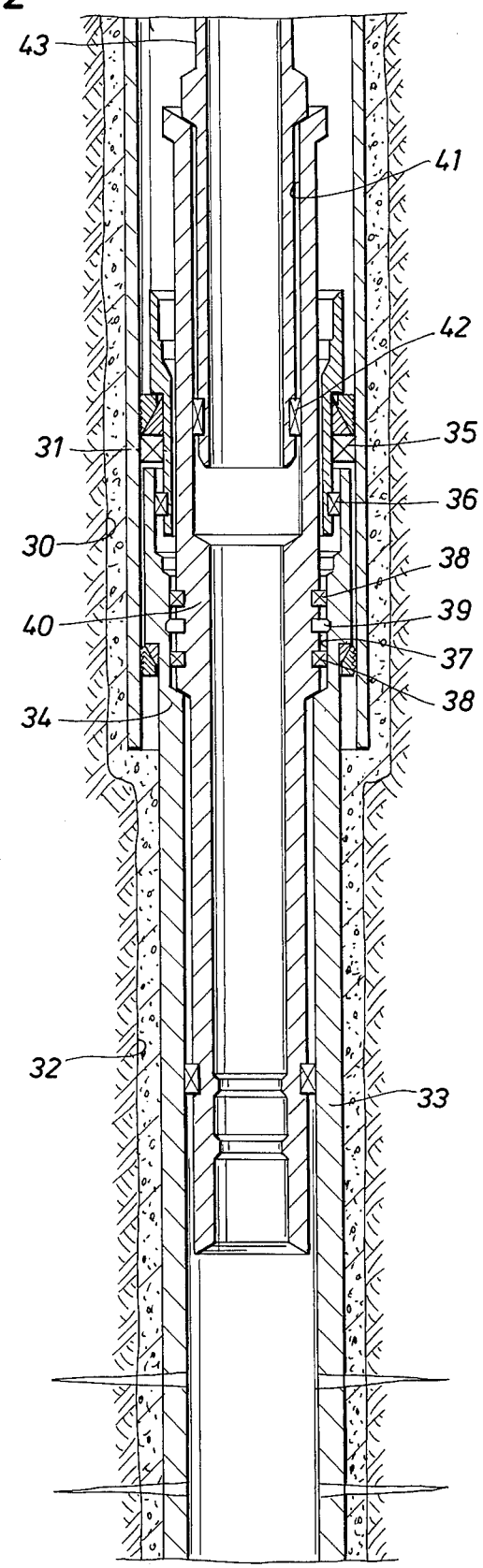
FIG. 2 illustrates a well configuration with a different type of polished bore configuration.

Referring now to FIG. 2, a section of borehole 30 is illustrated with an upper liner 31 cemented in place and a section of borehole 32 with a lower liner 33 cemented in place with perforations into the earth formations. The lower liner 33 has a liner hanger and a polished bore receptacle 34. A packer 35 is set above the liner hanger 34 with a packing element and a seal 36 in the liner receptacle. A latching groove 37 in the PBR 34 receives sealing elements 38 and latching members 39 of an insert polished bore receptacle 40. The receptable 40 has a polished bore 41 for reception of a sealing assembly 42 on a tubing string 43.

FIGS. 1 and 2 illustrates two variations of polished bore receptacles which are in use and susceptible to adaptation of the present invention.

Referring now to FIG. 3, the present invention is illustrated where the upper end 50 of a polished bore receptacle 51 is attached to the lower end of a tubular latch housing 52. The latch housing 52 has an enlarged bore section 53 which receives a tubular mechanical latching sleeve 54. The sleeve 54 is threadedly attached to internal threads in the latch housing 52. The bore 55 of the latch housing 52 corresponds generally to the bore 56 of the polished bore receptacle 51 or can be slightly greater in diameter to provide a clearance space for sealing elements to pass. In any event, the latch housing 52 is a tubular member which includes a J-slot groove system 60. The J-slot groove system as illustrated in FIGS. 4 and 5 includes diametrically opposed J-slots 61, 62 with a latching slot 63 having a dimension "D". Inclined surfaces 65 to the latching slots 63 are adapted to guide latch pins into the latching slot 63. A string of tubing is attachable to a coupling 70 which, in turn, attaches to a clutch sleeve 71. The clutch sleeve 71, in turn, attaches to the sealing assembly 72 which carries sealing elements 73 for sliding and sealing reception in the polished bore receptacle 51. Between the sealing assembly 72 and the coupling sub 70, the clutch sleeve 71 has a reduced diameter which slidably receives a tubular lock housing 75. The lock housing 75 has external diametrically opposed pin portions 76 which are adapted to be received into the J-slots 60 of the latching sleeve 54. At the lower end of the lock housing 75 is a downwardly facing clutch surface 79 which is adapted to engage with an upwardly facing clutch surface 77 on the sealing assembly 72. The upper clutch surface 76 circumferentially extends around the surface of the bottom end surface of the lock housing 75 to provide a ramp surface between the upper and a lowermost points of a vertical engagement surface 82. The lower clutch surface 77 has a reversely inclined ramp surface which is connected to a vertical clutch engagement surface 83.

In operation, the PBR 51 is initially set in the wellbore with a liner hanger and liner. After retrieving the setting tool for the liner hanger, the PBR 51 remains in the wellbore with the attached latch housing 52. If it is desired to use a limited travel of the string of tubing then a tubing string with an attached seal assembly 72 and a lock housing 75 are lowered in the wellbore until the pin members 76 engage the surfaces of the J-slot grooves 60 and are automatically rotated into the locking grooves 63, the locking housing 75 being freely rotatable on the sleeve member 71. The tool is then in the position as shown in FIG. 3 where the sealing assembly 72 is disposed in the polished bore receptacle 51 and the locking pins 76 are in the locking grooves 63. The sealing assembly 72 is now capable of reciprocating for the length of the sleeve member 71 between the clutch surfaces 79, 77 plus an additional travel "D" of the J-slot. Thus, upward travel of the sealing assembly 72 is limited by the length of the sleeve 71. Hence, the distance the tubing can shift upwardly and the effect of the helical buckling of the tubing can be controlled by limiting the length of the sleeve 71. The limited travel thus permits substitution of smaller tubing or less expensive tubing after the PBR is in the wellbore without fear of buckling the tubing.

When it is desired to remove the sealing assembly 72, the tubing string is picked upwardly until the clutch surfaces 79, 77 are engaged and the tubing assembly is rotated to the right which causes the vertical surfaces 82, 83 to engage and the pin members 76 removed from the locking groove 63 by an upward pull with right hand rotation on the tubing. Thus, the sealing assembly can be removed.

By way of further background, the length of a polished bore receptacle is typically about 30 feet in length. The use of the locking sleeve 54 in the PBR provides a safety factor for the completion operation in that the subsequent length of the string of tubing used can be precisely calculated relative to the travel desired and the length of tubing in the wellbore. This then provides a more precise determination of tubing lengths and greater versatility in selecting lengths, sizes and strength of tubing. The use of the locking sleeve permits the use of smaller diameter tubings with liners already set in the wellbore where the smaller tubing would ordinarily helically buckle if not for the limited travel of the tubing seal assembly.

Furthermore, should well treating pressures exceed amounts originally anticipated, the limited travel design prevents the tubing seal assembly from pumping out of the PBR by accident.

Figure 7:
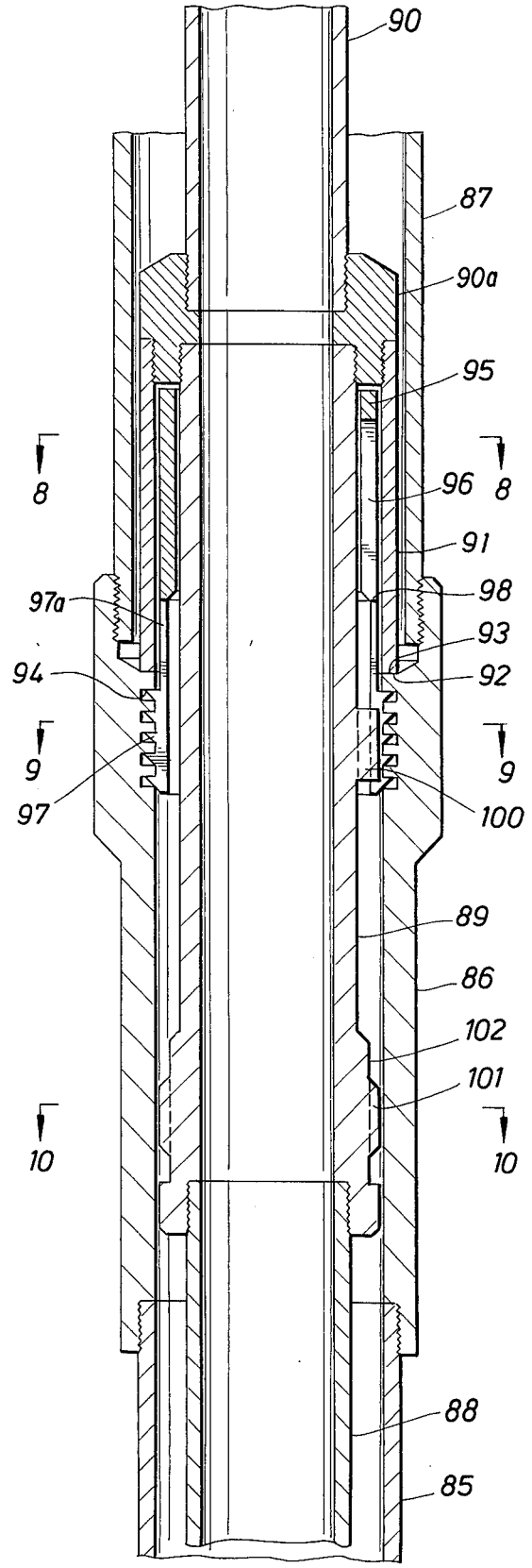
FIG. 7 illustrates a schematic cross section of another embodiment of the present invention.
Figure 8:
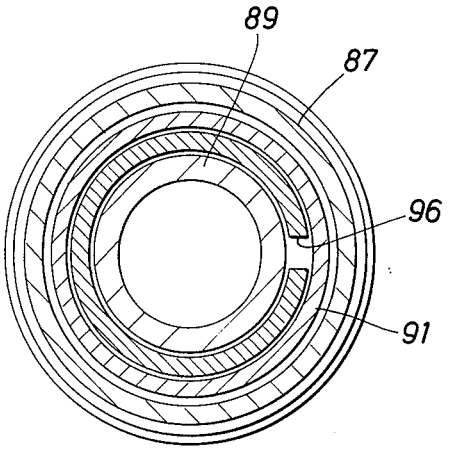
FIG. 8 is a view taken along line 8—8 of FIG. 7.
Figure 9:
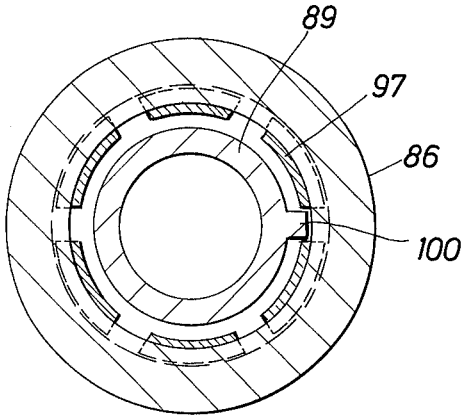
FIG. 9 is a view taken along line 9—9 of FIG. 7.
Figure 10:
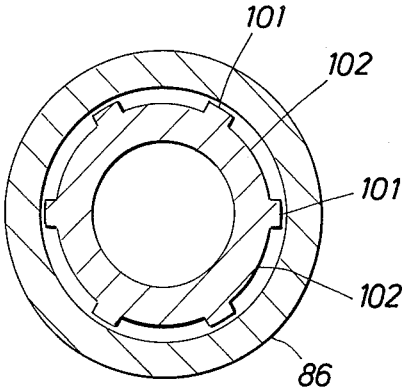
FIG. 10 is a view taken along line 10—10 of FIG. 7.

Referring now to FIG. 7, the upper end of a PBR 85 is shown theadedly attached to a tubular latching housing 86 which, in turn, is connected to a tubular guide housing 87. The sealing assembly (not shown) is connected by an upper tubular extension 88 to a tubular latch mandrel 89 which, in turn, is connected to a string of tubing 90.

The latch mandrel 89, at its upper end has a connecting sub 90*a* which carries a depending, concentrically disposed landing sleeve 91 which, in the position shown, has its lower end 92 abutting an upwardly facing shoulder 93 on the latch housing. Below the shoulder 93, the latch housing is provided with a latching thread groove 94.

Slidably disposed within the annulus between the sleeve 91 and the mandrel 89 is a tubular latch finger sleeve 95. The latch finger sleeve 95 has a single longitudinal keyway slot 96. The lower end of the finger sleeve 95 has circumferentially spaced slots 97*a* to provide six latch fingers 97 which can flex with respect to the point 98 for insertion into the thread groove 94. The latch fingers have external threaded sections for engagement with the thread groove 94. As shown in FIG. 7, the fingers 97 are in engagement with the groove 94 and the clearance between the backside of the fingers 97 and the outer surface of the mandrel 89 permit the fingers 97 to flex inwardly while being inserted until the end 92 engages the shoulder 93. At this time the fingers 97 engage the threaded groove 94.

The mandrel 89 has a key 100 which slides in the keyway slot 96. In the position shown the key 100 is located between two adjacent fingers 97 and is slidable upwardly in keyway slot 96 until it reaches the top of the slot 96 in the sleeve 95. Spaced downwardly from the key 100 is a locking key member 101 which is formed on an enlarged diametral portion 102 of the mandrel 89. When the key 100 is at the top of the keyway slot 96, the locking key member 101 is located in the key slots between the fingers 97 and the enlarged portion 102 so that the fingers 97 are locked in the threaded groove 94.

When pressure below the sealing assembly lifts the mandrel 89 to a locking position the tubing 90 above the latching housing 86 is fixed and will not travel upwardly to cause helical buckling.

To remove the tubing, rotation of the tubing string 90 unthreads the locking fingers 97 from the locking groove 94 permitting release of the tubing string.

It will be appreciated that the embodiments, as illustrated, permit the attachment of a releasable locking device to the top of a PBR. Subsequently, if it is desired to fix or limit the travel of a string of tubing relative to the PBR, the string of tubing is provided with a matching locking element for the locking device and the string of tubing can be releasably locked into the PBR. Thus, the string of tubing when so locked, need not be designed to avoid helical buckling of the tubing.

It will be apparent to those skilled in the art that various changes may be made in the invention without departing from the spirit and scope thereof and therefore the invention is not limited by that which is enclosed in the drawings and specifications but only as indicated in the appended claims.

We claim:

1. A polished bore receptacle for use in a wellbore comprising:

polished bore receptacle means adapted for location in a wellbore and having a polished bore for slidably and sealingly receiving a sealing assembly on a tubing string;

travel limiting means for limiting the travel of a string of tubing having a sealing assembly arranged for sliding and sealing reception in said polished bore receptacle means, said travel limiting means including a tubular locking housing adapted for coupling to a polished bore receptacle means, said locking housing having J-slot means for receiving locking pins;

a tubular locking sleeve slidably and rotatively mounted on a tubular mandrel for limited travel between spaced apart upper and lower shoulder means, said locking sleeve having pin means for engaging said J-slot means, said tubular mandrel being adapted for connection between a sealing assembly and a string of tubing, and clutch means on said lower shoulder means and on said locking sleeve for selective engagement for rotating said tubular locking sleeve out of locking engagement with said locking housing.

2. The apparatus as set forth in claim 1 where said tubular locking housing is arranged to be disposed concentrically within an enlarged bore of a polished bore receptacle means.

3. The apparatus as set forth in claim 1 wherein said J-slot means include at least one J-slot opening and said locking sleeve has at least one pin or finger means.

4. A polished bore receptacle for use in a wellbore comprising:

liner hanger means and a liner adapted for use in a wellbore;

polished bore receptacle means coupled to said liner hanger and having a polished bore for slidably and sealingly receiving a sealing assembly on a tubing string;

travel limiting means for limiting the travel of a string of tubing relative to the polished bore, while maintaining a sealing assembly in the polished bore, a sealing assembly adapted for coupling to a string of tubing and arranged for sliding and sealing reception in said polished bore, said travel limiting means including a tubular locking housing within said polished bore receptacle means, said locking housing having J-slot means for receiving locking pins or fingers, a tubular locking sleeve slidably and rotatively mounted on a tubular mandrel for limited travel between spaced apart upper and lower shoulder means on said tubular mandrel, said locking sleeve having extended pin or finger means for engaging said J-slot means, said tubular mandrel being connected to the sealing assembly and adapted for coupling to a string of tubing, and means on said lower shoulder means and on said locking sleeve for selective engagement for rotating said tubular locking sleeve out of locking engagement with said locking housing.

5. A polished bore receptacle for use in a wellbore comprising:

polished bore receptacle means adapted for fixed location in a wellbore and having a polished bore for slidably and sealingly receiving a sealing assembly on a tubing string;

travel limiting means for limiting the travel of a string of tubing having a sealing assembly arranged for sliding and sealing reception in said polished bore receptacle means, said travel limiting means including a tubular locking housing adapted for coupling to a polished bore receptacle means, said locking housing having thread means for receiving threaded members, tubular locking sleeve means mounted on a tubular mandrel, said locking means having thread members for engaging said threaded means in said locking housing, said tubular mandrel being adapted for connection between a sealing assembly and a string of tubing, and said threaded members being rotatable out of locking engagement with said locking housing.

6. The apparatus as set forth in claim 5 wherein said locking sleeve means includes a tubular sleeve carrying said thread members, said thread members being inwardly flexible for receipt into said threaded means in said locking housing, said mandrel being movable relative to said locking sleeve means and having an enlarged diametral portion for preventing flexing of said thread members when located beneath said thread members.

7. A method for limiting the travel of a sealing assembly within a polished bore receptacle disposed within a well bore above a liner hanger and depending string of pipe comprising the steps of:

positioning a polished bore receptacle in a fixed relationship with respect to a liner hanger in a well bore at a desired location where said polished bore receptacle has latching means including a J-slot;

lowering a tubular sealing assembly with an outer seal means by means of a string of tubing into sealing engagement of the outer seal means with the polished bore receptable; and releasably latching a pin means on the sealing assembly to the J-slot of said polished bore receptacle for preventing any substantial relative travel of said sealing assembly with respect to the polished bore receptacle until such time as the pin means on the sealing assembly is released from the J-slot in the polished bore receptacle.

8. A polished bore receptacle for use in a well bore comprising:

polished bore receptacle means adapted for fixed location in a well bore and having a polished bore for slidably and sealingly receiving a sealing assembly on a tubing string;

travel limiting means for limiting the travel of a string of tubing having a sealing assembly arranged for sliding and sealing reception in said polished bore receptacle means, said travel limiting means including, a tubular locking housing coupled to a polished bore receptacle means and having releasable locking means adapted to rotatively receive a locking element, a tubular locking sleeve slidably and rotatively mounted on a tubular mandrel and having a locking element for rotating into cooperative locking relationship with said releasable means, said tubular mandrel being adapted for connection between a sealing assembly and a string of tubing, and and means for selectively operating said locking sleeve for releasing said locking element from cooperative locking relationship with said locking means by rotation of said tubular locking sleeve and said locking element out of locking relationship with said locking housing.

* * * * *